United States Patent [19]

Fox

[11] 4,015,575

[45] Apr. 5, 1977

[54] INTAKE SYSTEM WITH FOCUSING MEANS

[75] Inventor: Albert H. Fox, Village of Shoreview, Minn.

[73] Assignees: Bryce J. Fox; Edna R. Fox, Village of Shoreview, Minn. ; part interest to each

[22] Filed: Apr. 10, 1975

[21] Appl. No.: 566,791

Related U.S. Application Data

[63] Continuation-in-part of Ser. No. 417,879, Nov. 21, 1973, abandoned.

[52] U.S. Cl. ..... 123/141; 48/180 R

[51] Int. Cl.[2] ..... F02M 29/00

[58] Field of Search ..... 123/141; 48/180 R, 180 F, 48/180 C, 180 M, 180 B, 180 S, 180 P, 180 H; 261/78 R

[56] References Cited

UNITED STATES PATENTS

| | | | |
|---|---|---|---|
| 1,359,279 | 11/1920 | Sansoucy | 48/180 H |
| 2,498,190 | 2/1950 | Weeks | 48/180 R |
| 2,535,410 | 12/1950 | Greuas | 48/180 R |
| 2,685,504 | 8/1954 | Ulbing | 48/180 R |
| 3,747,581 | 7/1973 | Kolb | 123/141 |

FOREIGN PATENTS OR APPLICATIONS

| | | | |
|---|---|---|---|
| 982,461 | 2/1965 | United Kingdom | 123/141 |

*Primary Examiner*—C. J. Husar
*Assistant Examiner*—Ira S. Lazarus
*Attorney, Agent, or Firm*—Robert C. Baker

[57] ABSTRACT

The intake system is adapted to supply a substantially intimately blended combustible mixture of fuel and air to a combustion machine. A conduit is provided for conducting a flowing stream of fuel and air to a combustion machine. Mixing means for blending the stream comprises a peripheral flow focusing structure for redirecting the flow of at least substantially all peripheral portions of the stream from vectors of generally linear flow substantially adjacent the interior surface of the conduit to vectors of inward flow interjacently substantially converging toward a central zone removed from the interior surfaces of the conduit and removed from the focusing structure.

14 Claims, 9 Drawing Figures

INTAKE SYSTEM WITH FOCUSING MEANS

This application is a continuation-in-part of my application Ser. No. 417,879, filed Nov. 21, 1973 now abandoned.

This invention relates to an intake system adapted to supply a substantially intimately blended combustible mixture to a combustion machine. More particularly, this invention relates to an intake system having a focusing structure for redirecting the flow of a stream of fuel and air in such manner as to cause peripheral portions of the stream to move inwardly in interjacently converging fashion and thereby effect substantially intimate blending of the air and fuel of the stream. The invention also relates to improved combinations of intake systems and combustion machines.

Teachings of the invention may be incorporated in the intake systems of a wide variety of different types of combustion machines, whether of the continuous burning type or of the intermittent burning type (as where burning takes place more or less as an explosion). For example, teachings hereof are useful in the intake systems of modulating burners, Rankine or other "external" combustion engines, internal combustion engines, whether reciprocating or rotary in character, and still others where effectively complete combustion at a controlled rate is desired. But the teachings herein are especially adapted for use in the intake systems for internal combustion engines, especially for automobiles; and for ready comprehension of the teachings herein, much of the terminology employed in describing background factors will be that most familiarly used in connection with intake systems for internal combustion engines of automobiles.

Conventional carburetor intake systems do not thoroughly blend the fuel and air fed to an engine. Thus, different combustion chambers of a multi-chamber engine (as well as the single combustion chamber of a single chamber engine or any one chamber of a multi-chamber engine) receive different and non-uniformly mixed masses of fuel and air when conventional carburetor intake systems are employed. The mixture may be excessively fuel rich above stoichiometric on one cycle (which therefore becomes a source of pollution), and so lean in fuel on the next that misfiring or firing failure occurs (which also causes pollution). Because of this phenomenon, the intake systems conventionally employed are generally adjusted to provide at least sufficient fuel to cause firing, and generally are adjusted to provide a substantial excess of fuel above stoichiometric (which is wasteful and causes pollution).

The non-uniformity of such fuel-air mixtures is especially pronounced under idling and low power conditions of operation for an internal combustion engine (whether of the rotary or reciprocating type). Under such conditions (i.e., idling and low power), the average velocity of the fuel-air mixture passing through the intake system is relatively low, which contributes little toward intermixing of the fuel and air in the conduiting arrangements of conventional carburetor-type intake systems. At higher velocities, commonly encountered when an engine is operated under conditions close to its maximum power output, conduit turbulence of some degree contributes to some intermixing of the fuel and air. Unfortunately, conventional arrangements also contribute to the holding of larger fuel droplets in air suspension, which contributes to the problem of pollution.

A further characteristic of conventional carburetor-type intake systems is that the major feed of fuel into the system under idling and low power conditions shifts from the main fuel venturi inlet to an idler fuel inlet or inlets at the throttle control portion of the system. The idler are normally and generally desirably located on only one side of the main intake conduit of the system. However, the throttle control plate of conventional carburetor systems, under conditions of relative idling or low power engine operation, tends to allow a wall or film of air to flow through the far side of the throttle plate portion of the intake conduit (most removed from idler fuel inlets) without significant intermixing of the same with idler fuel--except as any incidental mixing may thereafter take place in the system. Unfortunately, conventional downstream conduiting does little to prevent some curtains of mostly air from moving (under idling or low power conditions) in more or less aligned relationship within the conduiting. The arrangement does little to cause any intimate blending of fuel and air under idling or low flow conditions, and thus contributes to fuel waste and pollution.

Still further, conventional carburetor intake systems do little to prevent liquid gasoline from flowing (or even condensing) on the interior surfaces of the main conduit thereof during engine start up from an inoperative or relatively cool condition. Again, excess fuel must be metered into them to allow for such surface flow and still present a combustible mixture for the engine. Once warmed up, liquid fuel flowing on interior surfaces evaporates and contributes to temporarily excessively fuel rich mixtures. And again, pollution results.

By employing teachings of this invention, the stream of fuel and air moving through the main conduit of the intake system is substantially intimately blended before it enters the combustion chamber or chambers of a combustion machine. The stream is "focused" in a manner which substantially breaks up liquid fuel droplets into minute and even molecular particles. The "focusing" also substantially obviates the problem of any separate curtain of air moving downstream in substantially parallel or aligned and nonintermixing relationship to the main stream of fuel and air. It also presents a substantial interference to the phenomena of liquid fuel flowing along the interior surfaces of the intake conduit; and it does all of this by directing such surface fuel as well as air-borne fuel and any air-rich streams or curtains into an interjacently converging turbulence removed from the interior surfaces of the intake conduit. Advantageously, these results can be achieved by practice of the preferred embodiments of the invention without significant interference with the power performance of an engine; maximum power output for an engine equipped with preferred embodiments for an intake system as taught herein need not be sacrificed in any significant way. But improvements in combustion, with fuel waste considerably mitigated, and with pollution problems considerably mitigated, can readily be achieved by using the teachings herein.

Still other advantages and benefits of the invention will be evident from the detailed disclosure set forth hereinbelow.

The prior art on intake systems and modifications thereof is extensive. Known prior art is contained in the following patents, which are United States patents unless otherwise noted: Buddington 904,246; San Soucy 1,359,279; Turner 1,375,265; Bonnell 1,453,656; Lidholm et al 1,456,135; Kinnie et al 1,495,696; Parker 1,503,004; Brush 1,605,214; Krefl 1,614,477; Thornton 1,633,050; Brinton, Jr. 1,701,607; Wayte 1,711,762; Hess 1,753,009; Heard 1,780,130; Engles 1,812,089; Goudard 1,842,866; Schaffner 1,882,966; Gustafsson 1,980,520; Delling 2,001,817; Mock 2,328,736; Haibe 2,353,665; Linn 2,377,088; Wassman 2,383,697; Eberhardt 2,393,760; Weeks 2,498,190; Shively 2,518,082; Grevas 2,535,410; Henning 2,658,734; Bosdet 2,659,667; Ulbing 2,685,504; Guffra 3,007,391; Phillips 3,030,084; Landrum 3,047,277; Hegna 3,057,606; De Palma 3,176,704; Sarto 3,353,801; Wisman 3,393,984; Walker 3,410,539; Walker et al 3,437,320; Toesca 3,467,072; Larson, Sr., et al 3,544,290; Kolb 3,747,581; Roberts 3,823,702; Great Britain 182,924 of July 12, 1922; Great Britain 507,977 of June 23, 1939; and Great Britain 982,461 of Feb. 3, 1965.

However, insofar as is known, the conceptual approach of a focusing structure as taught herein, as well as the structural and functional performance features taught herein, the problems mitigated or substantially overcome by the teachings herein, as well as the benefits realized by employing the teachings herein, are all matters not heretofore known or available to those skilled in the art.

The intake system of this invention is adapted to supply a substantially intimately blended combustible mixture to a combustion machine, especially an internal combustion engine. The system comprises conduit means for conducting a flowing stream of fuel and air to a combustion machine. An upstream air entrance means is employed for introducing air into the conduit means. An upstream fuel inlet means is employed for introducing fluid fuel into the conduit means. Further, included in the intake system is a mixing means, which is located downstream from both the air entrance means and the fuel inlet means. The mixing means comprises a peripheral flow focusing structure for redirecting the flow of at least substantially all peripheral portions of the stream (of fuel and air) from vectors of generally linear flow substantially adjacent the interior surface of the conduit means to vectors of inward flow interjacently substantially converging toward a central zone removed from the interior surfaces of the conduit means and removed from the focusing structure. The converging vectors of flow are effective to cause substantially intimate blending of the air and fuel of the flowing stream.

The focusing structure is structurally characterized by comprising wall means which extends inwardly within the conduit means from substantially the entire intersection between an imaginary plane substantially transverse to the conduit means and the interior surface of the conduit means. The outermost peripheral edge of the wall means is fixed to the conduit means at this intersection. Al least a portion of the wall means takes the form of an approximately annular rise wall spaced from the interior surface of the conduit means and extending upstream within the conduit means from the aforenoted imaginary plane. The rise wall includes passage means extending therethrough substantially adjacent the imaginary plane and throughout the rise wall. The passage means is for the flow of the stream in the aforenoted substantially converging fashion through the rise wall into the central zone.

The fuel inlet means may comprise, especially in intake systems for internal combustion machines, a main fuel inlet as well as an idler fuel inlet. A throttle valve means is usefully included for adjusting the flow of the stream of fuel and air within the conduit means at a throttle portion thereof downstream from the air entrance as well as from the main fuel inlet, but upstream from an idler fuel inlet.

The preferred embodiments of the invention have mixing means which include passage means fo fixed area for the stream of fuel and air. Such preferred passage means is substantially non-variable in passage area under and during all conditions for the operation of the intake system. However, the teachings also apply to variable area passages for focusing structures.

The invention will further be described with the aid of a drawing made a part hereof; wherein.

Figure 1:
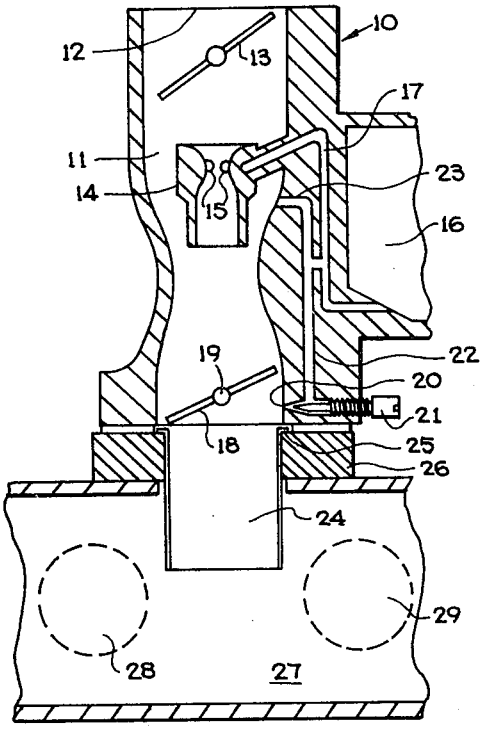
FIG. 1 is a schematic vertical cross-sectional view through a carburetor-type intake system in combination with a schematic focusing structure hereof, with parts broken away.

Referring to the drawing, particularly FIG. 1, several basic elements of a conventional or standard carburetor will first be described for orientation purposes.

Such a carburetor 10 comprises a main conduit means 11 for conducting a flowing stream of fuel and air to an internal combustion engine (not shown). An upstream port or opening 12 serves as an air entrance means for introducing air into the conduit means 11. Further, some sort of mechanically adjustable means or choke 13 is usually provided for controlling the quantitative rate of air passing through the air entrance 12 into the main conduit 11. Also an air filter or cleaning mechanism (not shown) may be added for the purpose of removing air-borne dust from the air drawn into the carburetor.

A venturi structure 14 is located in the main conduit 11 downstream from the air entrance. The venturi structure may be formed by contouring the walls of the main conduit; but it is also common to interpose at least one secondary or smaller venturi structure within the main conduit. The purpose of the venturi structure is to entrain at least a portion of the air flowing through the conduit 11 and cause an acceleration of its flow as well as a reduction of its pressure in that portion of the conduit.

Main fuel inlet means or ports 15 are associated with the venturi structure, at a portion of it where rapid air movement through it causes a reduced pressure condition to be created. Fuel enters through inlet 15 only when the flow of air through the venturi 14 creates a sufficient reduction of pressure within that portion of conduit 11 to draw the fuel from reservoir 16 (partially broken away) through the main fuel conduit 17 into the main conduit 11. A fluid fuel such as gasoline in the reservoir 16 is normally allowed to be under ambient or standard pressure conditions, as is well understood.

Also well understood is the fact that the suction effectively generated in the intake system (and carburetor) during operation of an internal combustion engine is suitably relied upon as the force for accomplishing air intake and fuel intake.

Downstream from both the air entrance 12 and the main fuel inlet or inlets 15 is a throttle valve plate 18.

It is pivotable on a shaft 19 so as to permit positive adjustment of the volume of permitted flow of the stream of fuel and air toward the engine. The energy output or power of internal combustion engines is essentially controlled by regulating the weight or volume of the fuel and air drawn into the combustion chamber or chambers of the engine on what is known as the intake stroke. The throttle valve 18 is capable of performing such a function; and the portion of the conduit 11 where plate 18 performs this function may be termed the throttle portion.

Throttle valve plate 18 is capable of pivotal movement about axis 19 from an "open" position to a "closed" position, and vice versa. In a fully "open" position, plate 18 is more or less aligned vertically within conduit 11. Such an alignment would be used only when maximum power output is expected from an internal combustion engine. Plate 18 is characterized as being in an "open" position, for conventional carburetors, whenever it is pivoted toward an alignment within conduit 18 to a sufficient extent to allow the suction of engine operation to draw sufficient air through the venturi 14 to cause substantially all significant fuel entering conduit 11 to enter through main metering jets 15 (and substantially terminate significant inflow of fuel through any idler port 20).

A fully "closed" position for plate 18 is accomplished whenever plate 18 is pivoted on axis 19 into a substantially transverse or "blocking" orientation across conduit 11. In the fully closed position, air flow through conduit 11 upstream from plate 18 is substantially reduced or "blocked". The closed position therefore causes a significant reduction or substantial termination of any significant air flow through the venturi 14. The result is that main fuel inlets 15 become substantially inoperative for introducing fuel into the conduit 11. The reduced air flow through the venturi 14 is incapable of causing a sufficient reduction of pressure to draw fuel through the inlets 15. However, literal termination of air flow through the throttle portion of the main conduit 11 is not likely to be achieved nor even desirable, even when the plate 18 is as fully closed as possible. The suction conditions generated by operation of an internal combustion engine create a considerable pressure drop across a throttle plate placed in "closed" position. Even in the closed position, air (generally at a sonic velocity) flows through minute spaces between the plate 18 and the interior surface of the conduit 11 at the throttle portion. But it is reduced (or substantially blocked) to cause results as just noted.

In addition to the main fuel inlet means 15 (through which fuel enters conduit 11 under normal speeds and loads other than idle conditions and low power conditions), conventional carburetors have a supplemental fuel metering means or idler circuit means for supplying fuel under idling and low power conditions.

The idler circuit illustrated in FIG. 1 includes an idler fuel inlet 20 on the interior side surface portion of the main conduit 11 at a downstream location from a substantially closed position for the throttle plate means. Generally, at least one idler fuel inlet is provided on that interior side surface portion of the main conduit at a location downstream and proximate to (that is, near) a closed position for the throttle plate 18. However, it is also common to employ a plurality of idler fuel inlets at such a location. They generally, in conventional carburetors, will all be in a relatively small area on one interior side surface portion of the main conduit. Some such inlets may even be slightly upstream from a closed position for plate 18; but it is not common practice to employ idler fuel inlets in an annular array completely around the main conduit 11 at the throttle plate portion thereof. Such an annular array of idler inlets might solve some fuel distribution problems during idling but also creates unwanted excess fuel and fuel control problems. An idler fuel adjustment valve means or screw 21 is suitably interposed in the passage 22 for the idler fuel from the reservoir 16 to the main conduit 11. A common practice is to include an air bleed passage 23 from the main conduit 11 upstream from plate 18 (and even upstream from venturi 14) to idler fuel conduit 22. In this manner, at least some air is premixed with idler fuel before the fuel enters conduit 11 under some conditions of idler operation. At least one idler fuel inlet 20 is usually located on the downstream side of a fully closed position for the throttle plate.

According to the teachings of this invention, there is interposed in the intake path for a moving stream of fuel and air, at a location which is downstream from the air entrance and fuel entrance (and preferably but not always critically downstream from any throttle control means) a mixing means having focusing characteristics; and this means is broadly and graphically denominated by numeral 24 in FIG. 1. Mixing means 24 is suitably equipped with a mounting flange 25 (denominated by the same number in all Figures of the drawing) for holding it at any suitable position in the main intake conduit, as illustrated. A practical position is that between the main carburetor housing 10 and a foundation or support housing 26.

Downstream from mixing means 24, and upstream from the site of combustion (preferably upstream from all sites or chambers of combustion), is located a further or distributing conduit structure 27 which conducts the mixture of fuel and air to the combustion site or chamber or chambers of a combustion machine. Conduit structure 27 is commonly termed a manifold where it serves as the porting or conduiting to more than one cylinder or combustion chamber of an internal combustion engine. Two such combustion chambers 28 and 29 are graphically represented in FIG. 1.

Various additional known or conventional elements (such as floats, adjustment screws or valves, mechanical linkages to control choke and throttle plate orientation, a balance tube for syphoning off excess main fuel under deceleration conditions, modifications for improved acceleration performance, fuel recycling passages, and others) are omitted from the illustrations in the drawing, since they are all well known and are best incorporated by reference. No detailed drawing of them is needed for understanding. Likewise, internal combustion engines (both reciprocating and rotary) are well known and need no drawing for understanding.

From the foregoing, it will be evident that, in conventional carburetor operation, the main fuel metering means or inlets 15 function to introduce fuel into the conduit 11 at normal speeds and loads of engine operation, whereas idler metering means 20 functions as the primary source to introduce fuel for idling and relatively low power conditions, The suction conditions generated within the conduit 11 by operation of an internal combustion engine are controlled and adjusted in degree by the positioning of the throttle plate 18 (through any suitable mechanical linkage for changing the attitude or position of plate 18 about plate axis 19). The pressure drop across the throttle plate 18 (that is, from the upstream to the downstream side of the plate) varies depending on the position of plate 18. Under idling conditions, when plate 18 is closed or close to that position, the pressure drop may typically be about 17 or 18 to about 20 inches of mercury. Fuel is induced under the closed plate condition to flow through idler port 20. As the throttle plate is moved slightly toward an open position (or slightly away form "closed"), additional idler ports (if present in the wall of the conduit 11) will gradually be exposed to the manifold vacuum. Opening the plate 18 still further causes the main fuel metering circuit 15 to become operative. Opening the plate to a cruising open position causes the manifold or downstream vacuum condition to decrease and the pressure drop across the throttle portion to be reduced to somewhere around 10 to 15 inches of mercury. Additionally, the resultingly reduced manifold vacuum condition causes the idler circuit to essentially become inoperative for any significant introduction of fuel.

To be especially noted is that, a relatively closed position for plate 18 of conventional systems allows air (either at sonic velocity or approaching such velocity) to pass as a curtain through the throttle portion of the main conduit along and approximately parallel to the interior surface of that conduit on both sides of the axis of the conventional throttle valve plate. Thus, in conventional systems, the portion of the air flowing across the idler inlet is readily exposed to fuel for mixing therewith; but such is not the case for the portion of the curtain of air flowing on the other side or far side of the interior surface of the conduit (most remote from the idler inlet).

While the foregoing is particularly applicable to conventional suction actuated carburetor systems, it should be emphasized that the mixing device teachings hereof may be employed not only in intake systems of the suction-actuated type, but also in intake systems of forced feed or supercharging type, as well as those of varied and modified combinations between such extremes. No particularly critical or significant pressure differential is required between the upstream and downstream side of a mixing device of this invention. However, no objection exists if one desires to introduce elements or effect intake operation under conditions causing a significant pressure drop or differential from the upstream to the downstream side of the mixing devices hereof. Preferably, if such is done, it will be done with concern for the least possible interference with the attainment of maximum engine power. The critical point is that the flow through the mixing devices hereof, preferably at the highest velocities attainable, consistent with other features of desired intake and combustion machine performance, effects the desired intimate blending of the fuel and air for the combustion machines. This intimate blending arises because of the extreme turbulance of the fuel and air mixture as it passes through passages of a rise wall portion of the mixing device. The rise wall passages cause any fuel droplets to be broken into a fine mist; and the turbulance of the converging concentric flow further contributes to misting of the fuel and thorough and substantially uniform dispersion of it in the air.

Figure 2:
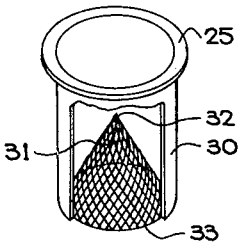
FIGS. 2 through 9 are schematic perspective views (with outer wall parts partially broken away to show interior detail) of various details for rise wall focusing structures of the invention.

One of the most preferred mixing means of this invention is illustrated in FIG. 2. It outer tubular or conduit wall 30 is essentially a continuation of the main conduit 11 of the carburetor of FIG. 1; and its outer wall is characterized as being part of the main conduit means.

Within outer wall 30 is a conical wall means 31, having its apex 32 upstream. Means 31 is a focusing structure. It consists essentially of a tapered cone of wire mesh or screen sheeting. The large end of the cone is open, that is, free or substantially free of any material across it.

The outermost peripheral edge 33 of the large end of the cone 31 is fixed to the main conduit means (that is, the continuation 30 of the conduit) either directly or through an intermediate flange or shelf of material (which in turn would be fixed to the conduit). The practical effect of this arrangement, as illustrated, is that the wall means (cone 31 of FIG. 2) of the focusing structure extends inwardly within the main conduit means 11 (that is, inwardly within main conduit extension 30) from a location of the main conduit having certain characteristics. Suppose an imaginery plane were passed transversely or substantially transversely across the main conduit (or main conduit extension 30). It would intersect the interior wall surfaces of the main conduit in a manner which would completely circumscribe the open portion of the main conduit. It is essentially from such an intersection that the outermost peripheral edge 33 of the wall means 31 extends inwardly within the conduit means. Thus, the wall means 31 is appropriately characterized, in a generic sense, as extending inwardly within the conduit means from substantially the entire intersection between an imaginery plane substantially transverse to the conduit means and the interior surface of the conduit means. All focusing structures illustrated in the drawing share this characteristic; they have a wall means of some sort which extends inwardly within the conduit from such an intersection of an imaginery plane as just noted.

Another feature of the structure illustrated in FIG. 2 is that its wall means 31 takes the form of an approximately annular rise wall within the main conduit, but spaced from the interior surface or surfaces of the main conduit. In other words, the annular wall 31 rises or extends from a "lower" to "higher" position. It ascends upstream within the main conduit (or main conduit extension) and is spaced from the interior surface or surfaces of the main conduit. In the case of FIG. 2, the rise wall has an upward slant to the apex 32. But, of course, it could be variously curved upwardly toward the apex, if desired. Indeed, the invention contemplates approximately annular (that is, circumscribing and therefore approximately annular) rise walls of a wide variety of types, but always of substantially circumscribing and therefore approximately annular configuration. The exact configuration (both cross-sectionally and in the upstream direction) may in part depend on the cross-sectional shape of main conduit, which usually will be approximately circular or round, but optionally may be square, oval or of some other shape. A particularly noteworthy rise wall, as illustrated in FIGS. 6 through 9, may be substantially cylindrical in shape. Thus rise walls which extend straight up within a main conduit section (but of the noted substantially annular configuration and spaced from the interior walls of the main conduit) are contemplated and are very useful to gain results as taught herein. From the standpoint of characterization, the structure of FIG. 2 (as well as other structures of the invention since all including approximately annular rise walls) has certain basic or critical characteristics which can be summarized as follows: At least a portion (maybe not all) of the wall means thereof (which wall means extends from the conceptual intersection aforenoted) takes the form of an approximately annular rise wall spaced from the interior surface of the conduit means and extending upstream within the conduit means from the intersection between the aforenoted imaginery transverse plane and the conduit walls.

Further, as readily evident from the description given above for the device of FIG. 2, the rise wall includes passage means extending sufficiently transversely through the rise wall (both in areas of it adjacent the imaginery plane aforenoted as well as throughout the rise wall) to permit the flow of fuel and air through the rise wall in a converging fashion into the central zone of the conduit means without trapping or holding liquid fuel in any reservoir or recess. The passage means (whether it has one or more openings) may have an opening which extends substantially annularly (that is, circumscribingly) about at least a longitudinal segment (in the upstream-downstream direction) of the rise wall. The passage means itself may take the form of a single spiraled (or substantially annular) passage, or a plurality of passage openings, or a multiplicity of the same (as in the case of the wire mesh cone of FIG. 2). The size of the passage openings can vary considerably. They may be extremely large in the case of a huge main intake conduit. Passages for conical structures as illustrated in FIG. 2 generally should be such that individual open spaces in the upstream direction are no greater than about one-half centimeter, and preferably are not over about a millimeter or half-millimeter. Their minimum dimension generally is best maintained above about one tenth millimeter--although some passage openings of even smaller or narrower size are not at all objectionable. Screen cones having openings of 100 U.S. mesh are very useful; but those of 300 U.S. mesh and 10 U.S. mesh also can be used, as well as others. Cone walls formed from a perforated sheet of metal are also useful.

The openings forming the passage means may be slit like, round, square, rectangular, annular or spiral, or of other desired shape. Passage means extend through the rise wall structure in substantially annular (that is, substantially circumscribing) relationship in at least a longitudinal segment of that structure. The critical performance features for the passage means is that of allowing passage and that of redirecting the flow of the stream in the converging manner to be more fully explained below, and that of atomizing fuel droplets.

The opening or plural openings forming the passage means is suitably fixed. It need not vary in any way during any and all conditions of operation of the combustion machine or the intake system for the machine. In this regard, it is desirable to employ passage means of ample passage or open area so that fuel and air flow through the passage means readily, with little or no significant pressure drop or differential from the upstream to the downstream side of the focusing structure (the downstream side being within the interior of a cone such as illustrated in FIG. 2). In doing so, little or no significant limitation on the maximum power output of an internal combustion engine need be caused by using a focusing structure according to the teachings hereof in the intake system.

But, if desired, passage means capable of functioning to cause a pressure drop of some significant degree from the upstream to the downstream side of the focusing structure may be used--as, for example, where temporary or momentary or permanent limitation on maximum engine performance is either not objectionable or is desired.

When a structure such as illustrated in FIG. 2 is interposed in an intake system, as at numeral 24 in FIG. 1, benefits aforediscussed for the teachings herein can be realized. A basic principle first to be recognized is that the flow through any orifice tends to be at a right angle to the surface of the orifice. In the device of FIG. 2, the flow tends to move from the interior surface of the cone 31 toward a centerline extending downwardly from the apex 32 of the cone. The vectors of flow through the main conduit need not make a literal right angle turn from the linear direction through the conduit. The angle of the turn from linear flow depends in part on the slope of the rise wall on the cone 31. Literal right angle emergence on the downstream side is not critical, but converging emergence, even if well downstream from the base portion of the cone, is critical.

In the conventional intake systems, the main or predominate vectors of flow (that is both the velocity or magnitude and direction of the moving molecules) are in the linear direction aligned with the conduit through which the flow is directed. The mixing devices hereof redirect those vectors of flow from the linear to a radially inward flow. The vectors of radially inward flow need not come into any line focus at the center line of a conduit. But they at least converge toward the center line, in somewhat haphazard fashion, and this is characterized as an interjacent converging fashion. The convergence of the inward vectors of flow is, at the very least, toward a central zone of the conduit structure of the intake system; and this central zone is clearly removed from the interior surfaces of the conduit. Further, the central zone is removed from the focusing structure (that is, removed from surfaces of the focusing means per se). The converging vectors of flow cause the molecules or particles or matter of the flowing stream to move closer together and be thrown against each other, with considerable turbulence and violence. The result is an extraordinarily effective blending of the fuel and air moving through the intake system. At the very least, substantially intimate blending occurs. To be further recognized, however, is that it is the peripheral portions of the total flowing stream of the intake system which are critical to redirect toward the central zone. These outer peripheral portions, which might be looked upon as curtains of flow along and adjacent the interior surface of the conduit, serve to effect substantially intimate blending of the entire stream when they are redirected in the converging fashion. Such redirection of the peripheral portions simultaneously "redirects" or disturbs and effects substantially converging turbulence for the entire stream of fuel and air (whether or not the central portion of the stream is also interrupted and redirected by structural means). Liquid fuel droplets in the stream are largely broken up and even atomized. Curtains of air along or adjacent interior surfaces of the conduit are forced into mixing relationship with other parts of the total stream. Liquid fuel moving along interior surfaces of the conduit is sputtered into the converging turbulence, which is removed from the interior surfaces of the conduit means; and such fuel is also substantially broken up into minute or even atomized particles during the converging intermixing step.

The improvements thus obtained over conventional carburetor operation may be better understood when one recognizes that, under the law of thermodynamics, the velocity of a gas passing through an orifice will reach sonic velocity (approximately 1100 feet per second under standard conditions) when the downstream pressure is less than about 53 percent of the upstream pressure. Such a condition can arise in a standard carburetor, especially for curtains of flow around a closed throttle. Without the focusing structure hereof, the curtain of flow on the idler inlet side of the throttle plate gets a chance to mix with fuel, but the curtain of air on the far side of the throttle plate (across from the idler inlet) gets little chance to become blended with idler fuel under the manifold vacuum condition and other conventional conditions prevailing. But the focusing structure hereof causes intimate blending of that far side curtain of air with the curtain of fuel and air. Thus, under the very conditions where unduly large excesses of fuel have heretofore been required in order to maintain satisfactory engine operation, with resultant unsatisfactory levels of exhaust pollution, the present invention permits more precise adjustment of the idler fuel intake to a lower value (toward and less than a stoichiometric ratio with the air intake), while also providing an intimately blended combustible mixture for satisfactory operation of all chambers of an engine. The result is that the problem of pollution is mitigated or substantially reduced under the idler and low power conditions of operation where it has been exceedingly serious heretofore.

It, of course, has heretofore been known that conventional carburetors may be adjusted to reduce exhaust carbon monoxide and hydrocarbons; and leaning of the fuelair mixture (as by adjusting idler valve controls, or by lowering the reservoir float level, or by using smaller and smaller main fuel jets) is known to give such a result. But conventional carburetors so adjusted (without employing teachings such as set forth herein) adversely affect the operation of an automobile, and require excessive choking particularly during the period of engine warm up and when ambient air temperature is below about 50° F. On the other hand, such leaned carburetors, when also equipped with a focusing structure as taught herein, have given satisfactory operation for the automobile under start up and the aforenoted low ambient temperature conditions without excessive choking. In fact, the driveability and choking requirements (very little choking being needed, even below the level required for average conventional carburetors) are noticeably improved; and exhaust pollutants are substantially reduced. Thus, redirection of the main stream into a converging stream as taught herein seems to effect a more significant improvement than what one might reasonably expect based on prior art concepts directed toward means for some sort of blending of fuel and air (but lacking the focusing concepts taught herein).

Figure 3:
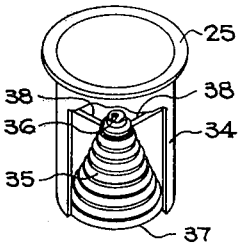

In FIG. 3, the focusing structure comprises conduit outer wall 34 with a conical rise wall 35 having passage means through it and having its apex 36 upstream from its open mouth. The peripheral edge 37 of the open mouth part is mounted in the conduit 34 at an imaginary transverse plane intersection with conduit 34, according to principles as aforediscussed. The conical rise wall is formed by spiraling a length of a rod or wire into the illustrated shape. Spider mounting arms 38 fixed between an apex portion of cone 35 and the wall of conduit 34 hold the spirals of the cone in any suitable predetermined spaced condition to provide a spiral passage of substantially fixed area and considerable circumscribing or annular length through a substantial portion of the entire cone.

Figure 4:
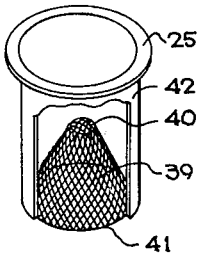

In FIG. 4, a focusing structure comparable to FIG. 2 is shown, except that the conical rise wall 39 is truncated with its apex removed. The opening defined by the upper edge 40 allows a central portion of the total stream to flow centrally through the cone 39; but the passages through the rise wall 39 redirect the flow of at least peripheral portions of the stream in the converging manner aforediscussed, causing the entire stream to occupy a central zone and be subjected to compaction of interjacently converging vectors of flow caused by the redirection of the peripheral stream portions. The outermost peripheral edge 41 is mounted in conduit 42 as aforediscussed. This structure also performs admirably in causing intermixing of curtains of flow adjacent conduit surfaces, as characteristic for the carburetor of FIG. 1 under idling conditions. To be noted is the fact that the truncated cone with central passage also can be characterized as being a flow separation structure, separating central from peripheral flow portions of the total stream.

Figure 5:
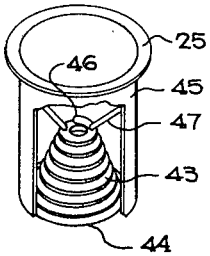

The focusing structure of FIG. 5 performs comparably to that of FIG. 4. In FIG. 5, the conical rise wall 43 extends upwardly from its outer peripheral portion 44 in spaced relationship form conduit 45. The cone 43 is truncated with its upper edge 46 defining an opening through the center of it. As in FIG. 3, the cone is formed by spiraling a band or rod or wire into the shape illustrated; and spider arms 47 hold the spiraled member with predetermined spacing between loops of the spiral. Thus a spiral passage is formed and extends in annular manner substantially throughout the upstream-downstream length of the truncated cone.

Figure 6:
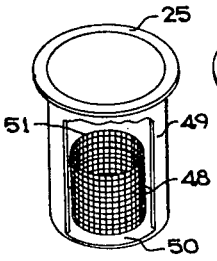

In FIG. 6, the rise wall 48 is cylindrical and is suitably formed out of wire mesh or screening; thus the passages extending through it are substantially perpendicularly disposed with respect to the direction of conduit member 49. Further its overall wallmeans--extending inwardly from the conceptual intersection aforenoted--includes an approximately annular (that is, circumscribing) flange or ledge or shelf 50. Shelf 50 extends inwardly from that intersection in a direction which preferably is substantially in a plane transverse to the conduit means. Thus annular shelf 50 extends inwardly substantially along the imaginary plane forming the conceptual intersection aforenoted. Cylindrical rise wall 48 extends upwardly from about the inner edge of shelf 50. Both ends of cylinder 48 are open (and the structure serves to separate the flow of central portions from peripheral portions of the stream). The upper opening is defined by edge 51. The open center character allows central linear flow, but this is interrupted by the converging vectors of flow caused when the peripheral portions of the stream are redirected inwardly by the passages of the cylinder 48. Performance is comparable to the devices of FIGS. 4 and 5, except that the redirection of peripheral vectors of flow by this device more dramatically effects high compaction and intermixing.

Figure 7:
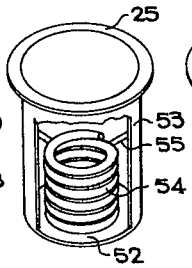

The focusing structure of FIG. 7 is comparable in performance to that of FIG. 6. Annular shelf 52 extends inwardly from and is fixed to conduit wall 53 at the conceptual imaginary plane intersection aforenoted. (Of course, shelves 50 and 52 might be perpendicular to the conduit or extend as funnel like segments projecting up or down.) Cylindrical rise wall coil 54 is held in predetermined open condition by spider mounting arms 55 so as to form a spiral passage along its length. Open passages are present at both ends of the upstream extending rise wall 54.

Figure 8:
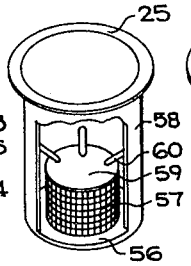

FIG. 8 is comparable to FIG. 6 in many respects. Its elements include wall means comprising annular shelf 56 plus wire mesh cylindrical rise wall 57 within conduit 58. However, the upper end opening of the cylindrical rise wall 57 is closed in FIG. 8. A plate 59, essentially devoid of passage means therethrough, covers the upper opening of the cylinder 57 and prevents central flow of the stream therethrough. Spider mounting arms 60, fixed from wall 58 to plate 59, are desirably included to brace the focusing structure against collapse in the event of possible sudden changes of flow pressure as might be encountered in operation for some structures of this type. The structure is exceedingly efficient in causing the redirected radially inward flow, with the convergence on the downstream side substantially within the cylinder 57 but also trailing downstream from shelf 56.

Figure 9:
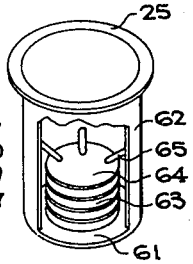

The structure of FIG. 9 performs comparably to that of FIG. 8. The elements of FIG. 9 include the annular shelf 61, conduit wall 62, spiraled cylindrical rise wall 63 having a fixed predetermined spiral passage, plate 64 which blocks central passage through cylinder 63, and mounting arms 65.

Central passage means through devices hereof offers advantages in terms of greatly minimizing chances of getting any significant pressure differential between the upstream and downstream sides, and therefore permitting maximum response to throttle control for operation of an engine.

A major reason for referring to vectors of flow herein, as distinguished from flow of molecules per se, is because the flow of molecules is accompanied by random motions which are difficult to assess. But the main thrust of the flow of any stream of air and fuel, or any significant portion of such flow (such as the peripheral portion verses the central portion), has a vector of magnitude and direction which, as taught herein, can be changed, with exceedingly beneficial blending results for the total stream.

In all illustrated embodiments, the inward flow substantially reduces problems of condensation and flowing of gasoline on interior conduit surfaces leading into the combustion chamber, even during periods of engine warm up.

If desired, focusing structures of the invention may be still further modified beyond illustrative types shown in the drawing. Resistance heating elements may be added to the focusing device itself or incorporated in the intake system at selected locations to facilitate operation during engine warm-up. Elements such as baffles, vanes, and the like may be added to effect swirling motions or other vectors of movement beyond those characterized herein. While the focusing system hereof is free or substantially free of parts which move or shift in location during its operation, the option exists to incorporate moving parts within the system.

The test results in Table I below further illustrate beneficial results gained by practice of this invention, and are set forth for purposes of illustration and not limitation.

Table I

| Device | R.P.M. | CO | HC |
|---|---|---|---|
| Ford S1 | 750 | 1.2 | 360 |
| | 1000 | 3.5 | 280 |
| | 1500 | 3.8 | 640 |
| | 2000 | 1.2 | 600 |
| | 2500 | 0.6 | 480 |
| Ford S2 | 750 | 0.7 | 400 |
| | 1000 | 2.2 | 250 |
| | 1500 | 3.5 | 680 |
| | 2000 | 1.0 | 860 |
| | 2500 | 0.6 | 460 |
| Ford X1 | 700 | 0.4 | 260 |
| | 1000 | 1.6 | 240 |
| | 1500 | 3.2 | 600 |
| | 2000 | 0.7 | 460 |
| | 2500 | 0.4 | 150 |
| Ford X2 | 800 | 0.2 | 260 |
| | 1000 | 0.2 | 120 |
| | 1500 | 0.4 | 420 |
| | 2000 | 0.3 | 160 |
| | 2500 | 0.4 | 60 |

The identification "Ford" refers to a 1963 Ford automobile, equipped with original equipment 289 cubic inch V-8 engine. The numbers under R.P.M. represent the engine speed in revolutions per minute (with the transmission in neutral gear) at which the exhaust emissions were measured. The numbers under CO represent the percent carbon monoxide measured in the exhaust gases and the numbers under HC represent the parts per million of hydrocarbons measured in the exhaust gases.

Ford S1 indicates the Ford automobile with its standard carburetor, 0.046 size metering jets, the float level 1/3 inch lower than normal, and the idle mixtures set toward the lean side of smoothest engine idle; but no device of this invention. Ford S2 is the same as Ford S1 (no device of invention) except that, with the engine idling at about 700–800 R.P.M., the idle mixtures were adjusted to smoothest engine operation and then gradually further leaned to give about the lowest CO reading without substantial increase of hydrocarbons. Ford X1 indicates the same conditions as S1 except that the device of FIG. 7 was added and the idle mixtures were then adjusted preliminarily in the same manner as done for S2. Ford X2 is like X1 except a device as shown in FIG. 2 was employed. (The automatic spark advance for the engine was not adjusted; it came into operation at a little below 1500 R.P.M.)

The carbon monoxide and hydrocarbon measurements were made with an infrared type exhaust gas analyzer; model 42-151 manufactured by the Marquette Co. of Minnesota. What is felt to be extremely significant is the favorable trend of improvements illustrated by the figures. It is important to recognize that air conditions for each test were inherently not identical; and this factor further complicates direct comparison. For the most part, the start up performance and improvements in operation of the engine when equipped with an intake system according to the invention can best be described qualitatively--for the reason that quantitative figures are so difficult to obtain with reliability for direct comparison. Also, to a large extent, exhaust gas pollutants theoretically can be reduced solely by adjusting a carburetor to meter leaner fuel-air ratios. But without the use of a mixing blending device of the invention, the resulting driveability of the automobile is not satisfactory. The engine may miss or not fire periodically; and the result is irregular performance. The devices hereof improved mixing and blending to the extent that they permit satisfactory operation and driveability at very lean mixtures, and therefore permit fuel conservation (and permit improvement in mileage for automobiles; something on the order of about 10% or greater improvement being possible), as well as desirable reduction of pollutants in a practical manner for desired reliable engine performance.

Because of the improved uniformity of the mixture, the tendency for detonation or pinging is reduced and a lower octane fuel may be used or the ignition timing advanced for improved economy.

That which is claimed is:

1. An intake system adapted to supply a substantially intimately blended combustible mixture to a combustion machine, said system comprising conduit means for conducting a flowing stream of fuel and air to a combustion machine, upstream air entrance means for introducing air into said conduit means, upstream fuel inlet means for introducing fluid fuel into said conduit means, and mixing means downstream from said air entrance means and from said fuel inlet means, said mixing means comprising a peripheral flow focusing structure for redirecting the flow of at least substantially all peripheral portions of said stream from vectors of generally linear flow substantially adjacent the interior surface of said conduit means to vectors of inward flow interjacently substantially converging toward a central zone removed from said interior surfaces of said conduit means and removed form said focusing structure, said converging vectors of flow being effective to cause substantially intimate blending of the air and fuel of said flowing stream, said focusing structure being characterized by comprising wall means extending inwardly within said conduit means from substantially the entire intersection between an imaginary plane substantially transverse to said conduit means and the interior surface of said conduit means, said outermost peripheral edge of said wall means being fixed to said conduit means at said intersection, at least a portion of said wall means having the form of an approximately annular rise wall spaced from said interior surface of said conduit means and extending upstream within said conduit means from said imaginary plane, said rise wall including passage means extending therethrough substantially adjacent said imaginary plane and throughout said rise wall for the flow of said stream in said substantially converging fashion through said rise wall into the said central zone.

2. The intake system of claim 1, especially adapted to supply a combustible mixture to an internal combustion engine, wherein said fuel inlet means comprises a main fuel inlet and an idler fuel inlet, and wherein said system additionally includes throttle valve means for adjusting the flow of said stream within said conduit means at a throttle portion thereof downstream from said air entrance means and from said main fuel inlet, said throttle valve means being upstream from said idler fuel inlet.

3. The intake system of claim 1 wherein said mixing means additionally is characterized by comprising passage means of fixed area for said stream, said passage means being substantially non-variable during all conditions for the operation of said intake system.

4. The intake system of claim 1 wherein said passage means of said rise wall is characterized by having a fixed passage area, said passage means being substantially non-variale during all conditions for the operation of said intake system.

5. The intake system of claim 1 wherein said rise wall is of substantially conical form.

6. The intake system of claim 1 wherein said rise wall is of substantially truncated conical form.

7. The intake system of claim 1 wherein said rise wall is of substantially cylindrical form.

8. The intake system of claim 7 additionally comprising a plate member over the upstream end of said cylindrical rise wall.

9. The intake system of claim 1 having passage means at the upstream end of said rise wall for the passage of the central portion of said stream therethrough.

10. The intake system of claim 1 wherein said wall means comprises an approximately annular shelf which extends inwardly from said intersection.

11. The intake system of claim 10 wherein said approximately annular rise wall extends upstream within said conduit means from the inner edge of said shelf.

12. The intake system of claim 11 wherein said rise wall is of substantially cylindrical form.

13. The intake system of claim 12 additionally comprising a plate member over the upstream end of said cylindrical rise wall.

14. The intake system of claim 11 having passage means at the upstream end of said rise wall for the passage of the central portion of said stream therethrough.

* * * * *